US006489871B1

(12) United States Patent
Barton

(10) Patent No.: US 6,489,871 B1
(45) Date of Patent: Dec. 3, 2002

(54) MAGNETIC WORKHOLDING DEVICE

(76) Inventor: Simon C. Barton, 10805 Martha's Way, Raleigh, NC (US) 27614

( * ) Notice: Subject to any disclaimer, the term of this patent is extended or adjusted under 35 U.S.C. 154(b) by 194 days.

(21) Appl. No.: 09/733,394

(22) Filed: Dec. 8, 2000

Related U.S. Application Data

(60) Provisional application No. 60/170,994, filed on Dec. 11, 1999.

(51) Int. Cl.[7] ..... H01F 7/20

(52) U.S. Cl. ..... 335/285; 335/289; 335/290; 335/294; 335/295

(58) Field of Search ..... 335/285–295; 269/8

(56) References Cited

U.S. PATENT DOCUMENTS

| | | | | | |
|---|---|---|---|---|---|
| 2,348 | A | * | 11/1841 | Laubach | 110/182.6 |
| 3,316,514 | A | * | 4/1967 | Radus et al. | 335/291 |
| 4,090,162 | A | * | 5/1978 | Cardone et al. | 335/289 |
| 4,356,467 | A | * | 10/1982 | Cardone et al. | 335/289 |
| 4,507,635 | A | * | 3/1985 | Cardone et al. | 335/291 |
| 4,777,463 | A | * | 10/1988 | Cory et al. | 335/286 |
| 4,847,582 | A | * | 7/1989 | Cardone et al. | 335/289 |
| 4,956,625 | A | * | 9/1990 | Cardone et al. | 335/290 |
| 5,041,806 | A | * | 8/1991 | Enderle et al. | 33/561 |
| 5,270,678 | A | * | 12/1993 | Gambut et al. | 269/8 |
| 6,002,317 | A | * | 12/1999 | Pignataro | 335/285 |
| 6,104,270 | A | * | 8/2000 | Elias | 335/289 |

* cited by examiner

*Primary Examiner*—Ramon M. Barrera
(74) *Attorney, Agent, or Firm*—Mills Law Firm PLLC

(57) ABSTRACT

A magnetic device includes a cylindrical outer pole having a central axis and formed of a ferromagnetic material including a circular base and a cylindrical sleeve defining an outwardly opening cylindrical cavity. A reversible magnetic unit located in said cavity includes a cylindrical core having a magnetic axis aligned with the central axis and a normal magnetic polarity in an inactive state. A cylindrical inner pole formed of a ferromagnetic material is operatively coupled to the core and inwardly radially spaced from said sleeve. An annular band between said sleeve and said inner pole formed of a permanent magnetic material has a magnetic polarity transverse to said central axis and magnetically aligned with said normal magnetic polarity of the core whereby an internal magnetic circuit is established in the inactive state through the poles, the core and the permanent magnet to the exclusion of said workpiece. When the polarity of the core is reversed an external circuit is established between the poles for magnetic coupling with the workpiece.

4 Claims, 6 Drawing Sheets

MAGNETIC WORKHOLDING DEVICE

CROSS REFERENCE TO RELATED APPLICATIONS

This application claims the benefit under 35 USC 121 of U.S. Provisional Application No. 60/170,994 filed on Dec. 11, 1999 in the name of Simon C. Barton and entitled "Magnetic Workholding Device".

FIELD OF THE INVENTION

The present invention relates to magnetic workholding devices, and, in particular, to a compact modular switchable permanent-electro magnetic device that may be deployed with respect to other such devices without magnetic influence therebetween.

BACKGROUND OF THE INVENTION

Magnetic holding systems employing electromagnets have been extensively used in applications requiring substantial magnetic force. In contrast with permanent magnets which have only one active state, the electromagnets may be selectively magnetized and demagnetized in achieving the desired activity. Inasmuch as the magnetized state is negated by intentional or inadvertent power loss, the possibility exists that magnetic field may be interrupted during lifting, transferring or holding activities thereby causing damage to surrounding property and personnel.

In an effort to overcome problems associated with power loss, switchable permanent-electromagnetic systems have been proposed. Therein, momentary activation reverses the polarity of a reversible magnet thus providing two stable magnetic states for the system; an active state wherein the magnetic field is coupled with the associated workpiece and an inactive state wherein the magnetic field is internalized. While performing satisfactorily in discrete environments, in order to achieve sufficient magnetic forces in larger applications involving substantial and irregular areas, a multiplicity of such magnets are generally required. Because of geometrical and deployment limitations, numerous problems can be presented. Generally, such systems must be arranged in prescribed biaxial arrays, generally based on square or rectangular poles. Accordingly, the flux paths are orthographically prescribed and dependent on surrounding poles. Such orientation results in excessive flux paths and heights in the workpiece as well as residual stray flux patterns in the workpiece that can undesirably reduce magnetic performance and attract particulate contaminants. Preferably the systems should operate at magnetic saturation in order to optimize performance and minimize sizing. Such operating conditions are difficult to attain in current geometrical arrays wherein the inherent variations in each magnetic subset also affect surrounding magnets. Accordingly time consuming assembly and testing is required, magnet by magnet, to avoid adverse cumulative effects in the assembled system. Furthermore, the need to maintain the prescribed pole patterns limits the ability to provide magnetic coupling at external or internal peripheries such as around workpiece openings and the like. Thus, notwithstanding advances over permanent magnet and electromagnet systems, the prior switchable permanent electromagnetic systems have not yielded uniform magnetic coupling, consistent manufacture, and flexibility of disposition.

For example, U.S. Pat. No. 2,348 to Laubach discloses a permanent lifting magnet whereby an electromagnet is energized to neutralize the effect of a main permanent magnet thereby releasing workpieces being transported.

U.S. Pat. No. 6,002,317 to Pignataro discloses an electrically switchable magnet system wherein a solenoid switched magnet is used to selectively provide an active and inactive magnetic condition for the system.

U.S. Pat. No. 4,956,625 to Cardone et al. discloses a magnetic gripping apparatus wherein paired pole units having permanent magnets interposed therebetween may be switched between an active and inactive magnetic condition.

U.S. Pat. No. 4,090,162 to Cardone et al. discloses a magnetic anchoring apparatus using longitudinally spaced pole sets separated by a permanet bridging magnet wherein one pole is alternatively conditioned by a switchable permanent magnet to provide an active and inactive magnetic condition.

U.S. Pat. No. 4,507,635a to Cardone et al. discloses a magnetic anchoring apparatus having quadrangular arrayed square poles separated by permanent bridging magnets.

U.S. Pat. No. 5,270,678 to Gambut et al. discloses a longitudinal series of paired square magnetic poles that are solenoid switched between magnetic states.

U.S. Pat. No. 5,041,806 to Enderle et al. discloses an electromagnetic holding device having concentric annular poles coupled with a radially polarized permanent magnet with the inner pole being magnetically reversed by a solenoid to effect magnetic states.

U.S. Pat. No. 4,777,463 to Cory et al. discloses a magnetic fixture assembly having a base with a permanent magnet which normally clamps a plate thereto but which is disabled to release the plate when an electromagnet is energized.

Therefore, a need exists for a switchable permanent electromagnet that can be readily manufactured and assembled to consistent and optimum specifications, disposed in flexible arrays without interference with or interdependence on surrounding magnets, and consistently operated at magnetic saturation.

SUMMARY OF THE INVENTION

The present invention accomplishes the foregoing needs by providing a switchable permanent electromagnet module that operates readily at magnetic saturation and low flux heights with flexible orientation of coupling with the workpiece, individually or in combination with other modules.

The module comprises an annular switchable inner pole surrounded by an outer pole field of similarly equal planar surface area to the inner pole. The inner pole is coupled to the outer pole with an annular permanent magnet and with a switchable permanent magnet controlled by an electromagnetic field. In an inactive state, the flux path is internalized through the module allowing unrestrained movement of the workpiece. In the active state, a flux path is established externally, radially and circumferentially between the coupling surfaces of the inner pole and the outer pole, through the workpiece with a shallow flux height. The outer pole may be variably geometrically configured with respect to the inner pole, requiring only sufficient area to permit the inner pole to achieve saturation. In individual modules, the outer pole is preferably a concentric annulus capable of achieving saturation. However, the outer pole may constitute a surrounding field in which other modules are deployed. Therein, the modules may be oriented for optimum coupling with the workpiece, substantially without regard to the location of adjacent modules. Even when positioned within overlapping outer pole annuli, the radial and circumferential flux distribution accommodates saturation without affecting surrounding magnets. Because of the lack of magnetic interference, the modules may be manufactured and tested, prior to unit assembly, solely for individual module performance and without regard to surrounding conditions. Further, inasmuch as the modules, either with integral outer poles or field outer poles, only require machined bores for assembly the overall rigidity of the magnet holding device is not adversely affected, in contrast with geometrical pole arrays wherein substantial areas must be removed for housing the magnet system. In addition to flexible relative position, the modules may also be deployed in varying relationships. Generally, the pole faces lie in a single plane transverse to the magnetic axis. However, varying inclined, multiple plane and irregular surfaces may be magnetically coupled at saturation.

DESCRIPTION OF THE DRAWINGS

The above and other objects and advantages of the present invention will become apparent upon reading the following detailed description of the preferred embodiment taken in conjunction with the accompanying drawings in which.

DETAILED DESCRIPTION OF THE PREFERRED EMBODIMENTS

The present invention as illustrated in the accompanying drawings and following description may be employed in a variety of applications wherein it is desired to magnetically couple a ferromagnetic workpiece to another device for transporting, clamping, locating and the like. The devices may be employed as independent magnetic modules and are particularly adapted for magnetically coupling parts and assemblies such as molds.

Figure 1:
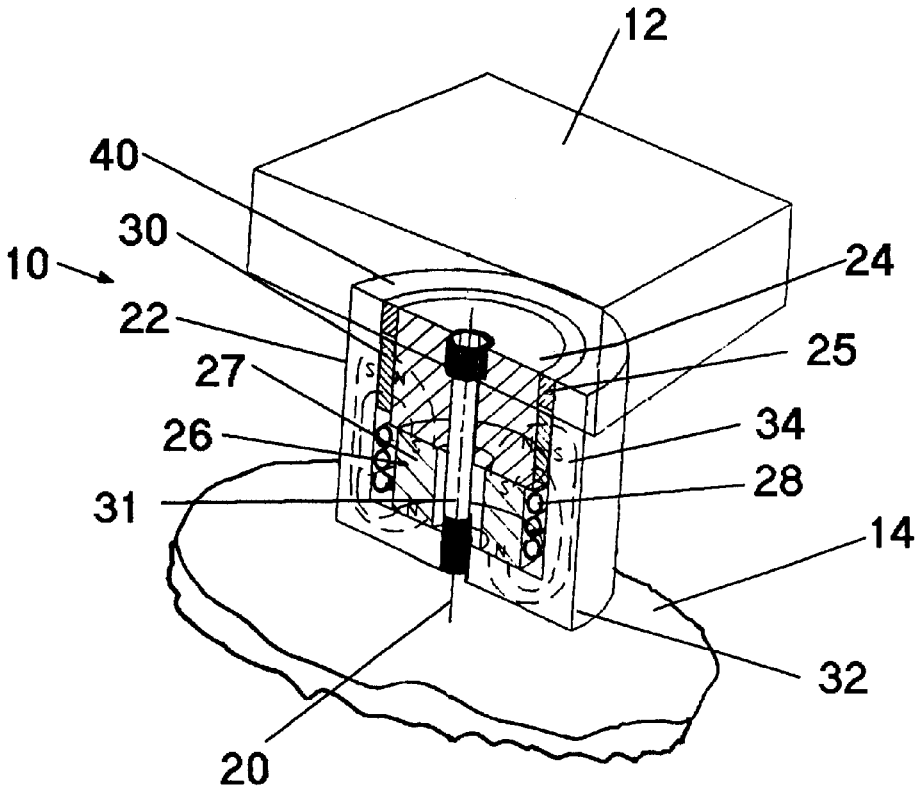
FIG. 1 is a partially sectioned perspective view of a switchable magnet device in an inactive state in accordance with an embodiment of the present invention.
Figure 2:
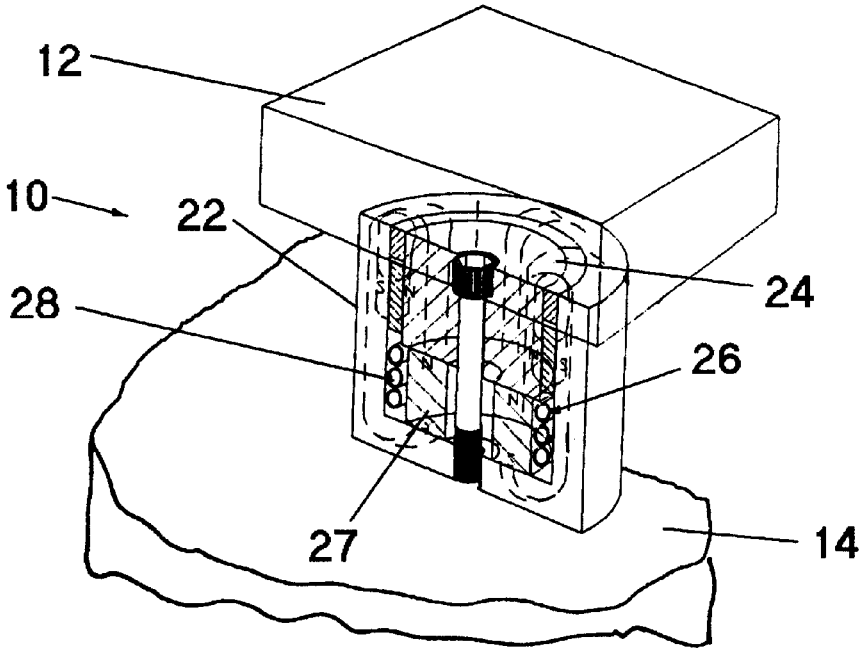
FIG. 2 is a partially sectioned perspective view of the magnet device of FIG. 1 in the active state.

Referring to the drawings illustrating a preferred embodiment of the invention, FIGS. 1 and 2 show a magnetic device 10 that establishes a magnetic clamping relationship with a ferromagnetic workpiece 12 for discrete location with respect to a mounting surface 14 to which the device 10 is attached or is associated by suitable fastening means, not shown. The workpiece 12 may be unitary or a component of an assembly wholly or partially of magnetizable material.

The device 10 is generally cylindrical about a central axis 20 and includes an outer pole 22, an inner pole 24, a non-magnetic spacer 25, a reversible magnet 26 including a permanent magnetic core 27 and a solenoid coil 28, and a non-reversible permanent magnet 30. A threaded bolt 31 extends through the centers of the aforementioned components to maintain the assembled relation. The outer pole 22 and the inner pole 24 have annular top pole faces lying in a common plane for engagement with and magnetic coupling to the workpiece. It is important that the outer pole sectional area is similar or greater than that of the inner pole in order to maximize magnetic flux transfer.

The outer pole 22 includes a circular base 32, and an axially extending cylindrical sleeve 34. The base 32 includes a threaded aperture coaxial with the central axis 20 for securing the threaded end of the bolt 31. The inner cylindrical surface of the sleeve 34 and the top surface 40 of the base 32 define an upwardly opening cylindrical cavity. The outer pole 22 is formed of a ferromagnetic material.

The core 27 is formed of a suitably low coercive material such as Alnico. The core 27 is smaller in diameter than the cavity of the sleeve and coaxially aligned therewith. The core 27 includes a center through hole with a clearance relation with the bolt. The core 27 has a height in combination with the inner pole equal to the depth of the cavity. The core 27 is exteriorly encircled by the solenoid 28, the arrangement being such that the permanent magnet 26 has a clearance fit with respect to the solenoid's internal diameter. The solenoid 28 is connected in a conventional circuit, not shown, with the device 10 for switching between an active state and an inactive state as described below.

The inner pole 24 is cylindrical and includes a central counterbored hole for receiving the head and shank of the bolt 31 (note bolt can be reversed if preferred) . As illustrated, the inner pole 24 has an outer diameter slightly larger than the core 27 and a clearance relationship with the inner surface of the sleeve 34 to define therebetween an annulus for the receipt and housing of the spacer 25 and the permanent magnet 30. The inner pole 24 is formed of a ferromagnetic material.

The permanent magnet 30 is cylindrical and attached by interference fit or other suitable means to the outer surface of the inner pole 24. The permanent magnet 30 has a close sliding fit with respect to the inner surface of the sleeve. The permanent magnet 30 has a lower annular surface axially spaced from the solenoid 28 and an upper surface spaced below the top surfaces of the sleeve 34 and inner pole 24 to allow reception of the spacer 25. The permanent magnet 30 is formed of permanently magnetized material such as Neodymium Iron Boron or an alternative high coercive magnetic material.

The spacer 25 is cylindrical and is compressively retained between the sleeve 34 and the inner pole 24. The spacer is formed of a non-magnetic material such as brass and serves [firstly to maintain a paramagnetic space between the ferromagnetic parts and secondly to] seal the interior from contaminants. In assembly, the top surfaces of the spacer 25, the sleeve 34 and the inner pole 24 lie substantially in a common plane transverse to the central axis 20.

In an inactive state as shown in FIG. 1, the core 27 has a magnetic axis parallel to the axis 20 with a pole orientation as representatively illustrated. The permanent magnet core 27 is similarly polarized with an axis transverse to the axis 20. According, an internalized magnetic circuit is established as indicated through induction of the outer pole 22 and inner pole 24. The components and magnetic properties are interrelated to completely internalize the magnetic flux in the inactive state to prevent attraction thereto of undesirable contaminants.

Referring additionally to FIG. 2, the solenoid 28 is momentarily activated in a conventional manner to establish the active state for clamping the workpiece. Therein, the polarity of the core 27 is reversed resulting in an externalized magnetic circuit through the workpiece effectively clamping the latter thereto. By thereafter applying a reverse current to the solenoid 28, the inactive state is reestablished releasing the workpiece from the device 10.

The switchable permanent-electromagnet of the present invention may be deployed for magnetically clamping a variety of surface configurations and is not limited to the clamping of planar annular surfaces as described above.

Figure 3:
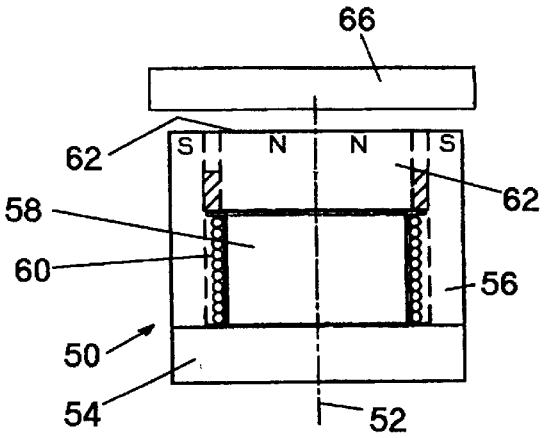
FIG. 3 is a cross section schematic view of an embodiment of the present invention having a transverse planar coupling interface.

Such variations for purposes of exemplification and not limitation are illustrated in FIGS. 3 through 6. Referring to FIG. 3, there is shown the aforedescribed magnet 50 symmetrically disposed about a central axis 52. The magnet 50 comprises a circular base plate 54 and a cylindrical induced outer pole 56. Disposed interior of the pole 56 is an annular switchable magnet 58 surrounded by a solenoid 60. An annular center pole 62 is positioned on top of the magnet 58 and coaxial therewith. The solenoid 60 is connected to a switchable power supply as described above.

An annular permanent magnet 62 is disposed between the lower portion of the center pole and the outer pole. The permanent magnet 62 has a magnetic axis transverse to the central axis 52. A non-magnetic ring 64 is disposed and fills the space above the magnet 62. The top surfaces of the inner pole 56, the ring 64 and the outer pole 56 lie in a common plane transverse to the center axis 52 for magnetic coupling with a workpiece 66.

Figure 4:
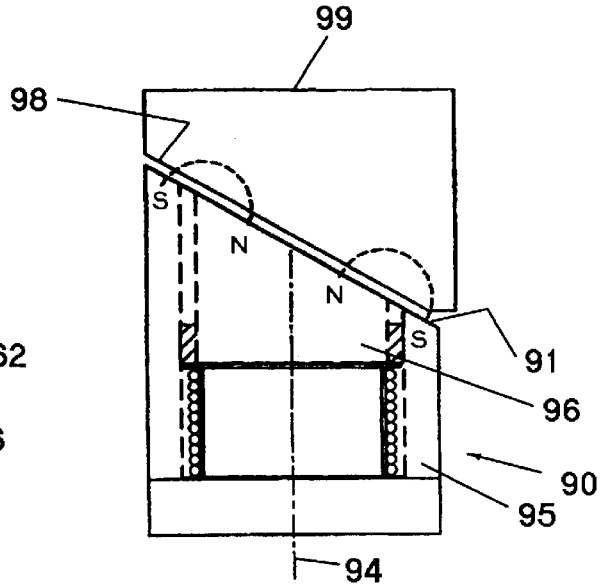
FIG. 4 is a cross sectional schematic view of another embodiment having an inclined coupling interface.

As shown in FIG. 4, the magnet 90 may be provided an inclined magnetic coupling surface 91 may lying in a plane inclined with respect to the central axis 94. Other than the structural modifications to the outer pole 95, the inner pole 96 and the retainer ring 97, the details of the components may be comparable to those shown in FIG. 3. Herein, the coupling or clamping surface is effective for engaging the complementary working surface 98 of a workpiece 99. To compensate for the resultant changes in attractive areas and maintain the aforementioned balance, requisite portions of the face of the inner pole 96 and the face of the outer pole 95 may be removed by suitable design.

Figure 5:
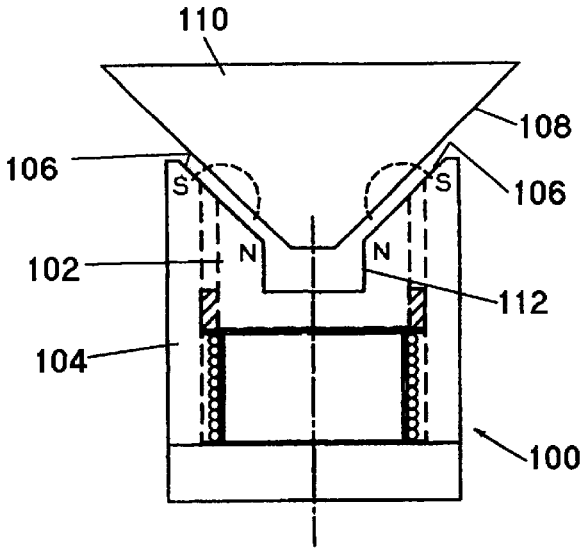
FIG. 5 is a cross sectional schematic view of another embodiment having an inclined biplanar coupling interface.

Further, as shown in FIG. 5, it is not necessary that the clamping surface lie in a single plane. Therein the magnet 100 has the inner pole 102 and the outer pole 104 formed with a V-shaped transverse groove having pole surfaces 106 complementary to downwardly and inwardly converging working surfaces 108 on a workpiece 110. A counterbore 112 may be formed in the top surface of the inner pole 102 for receiving the lower apex of the workpiece 110. In the operative condition, the annular areas of the inner pole and the outer pole are in balance whereby a uniform radially directed circumferentially extending flux pattern is established through the workpiece as indicated between the inner pole and the outer pole. It will also be apparent that the groove may be a surface of revolution for receiving a conical apex and the workpiece.

Figure 6:
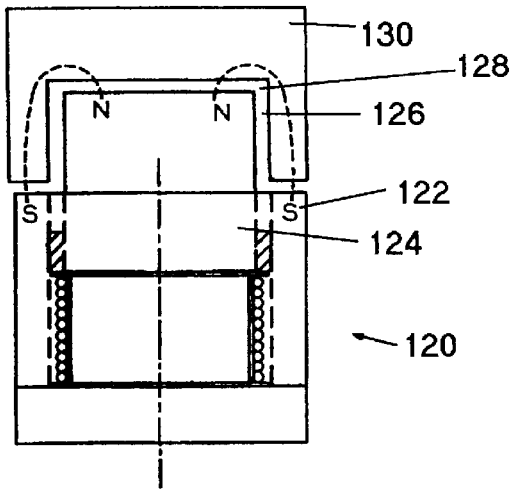
FIG. 6 is a cross sectional schematic view of another embodiment having a multiple plane coupling interface.

Further, as shown in FIG. 6, the magnet 120 includes an inner pole 122 and an outer pole 124 lying in different planes for magnetically clamping a complementary formed workpiece. Therein, for purposes of illustration, the design of FIG. 3 is modified by providing a cylindrical pole extension 126 atop the inner pole 122. A corresponding cavity 128 is formed in the lower surface of the workpiece 130. In operation, a similar radially directed circumferential flux pattern is established through the workpiece as illustrated by the dashed lines.

Figure 8:
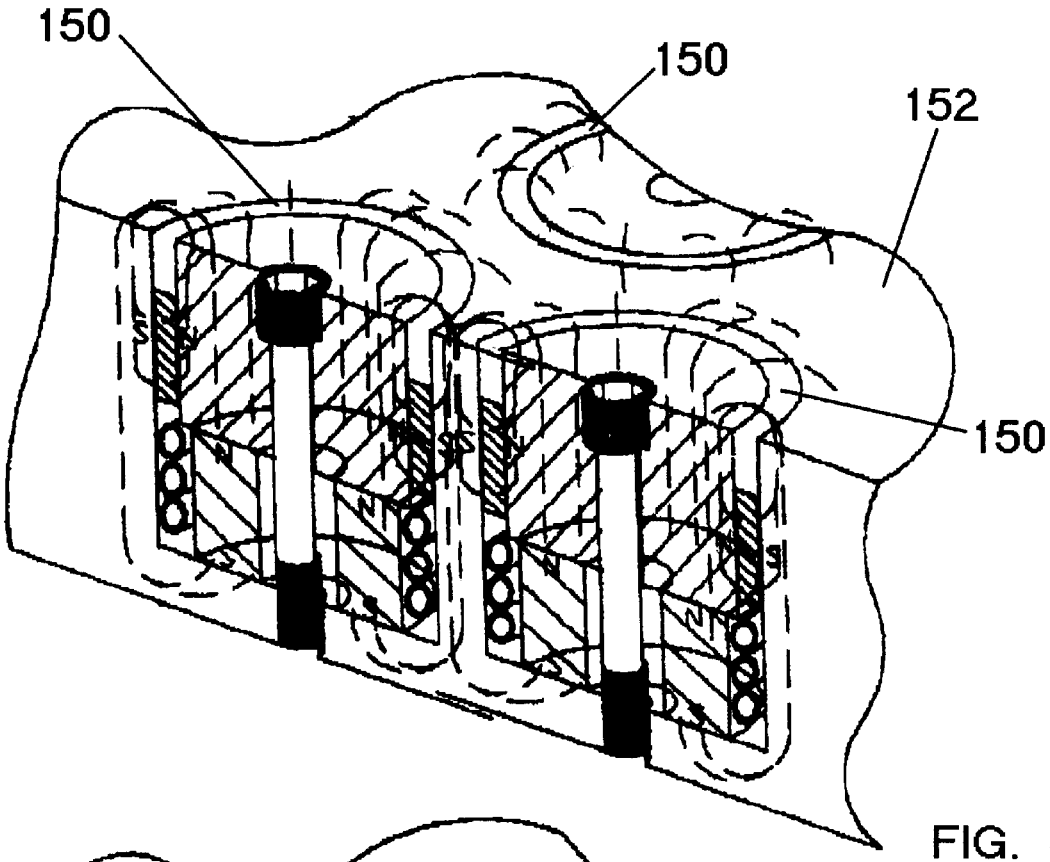
FIG. 8 is a partially sectioned perspective view of a switchable magnet system having plural modules in a common field, in an active state in accordance with a further embodiment of the present invention.
Figure 9:
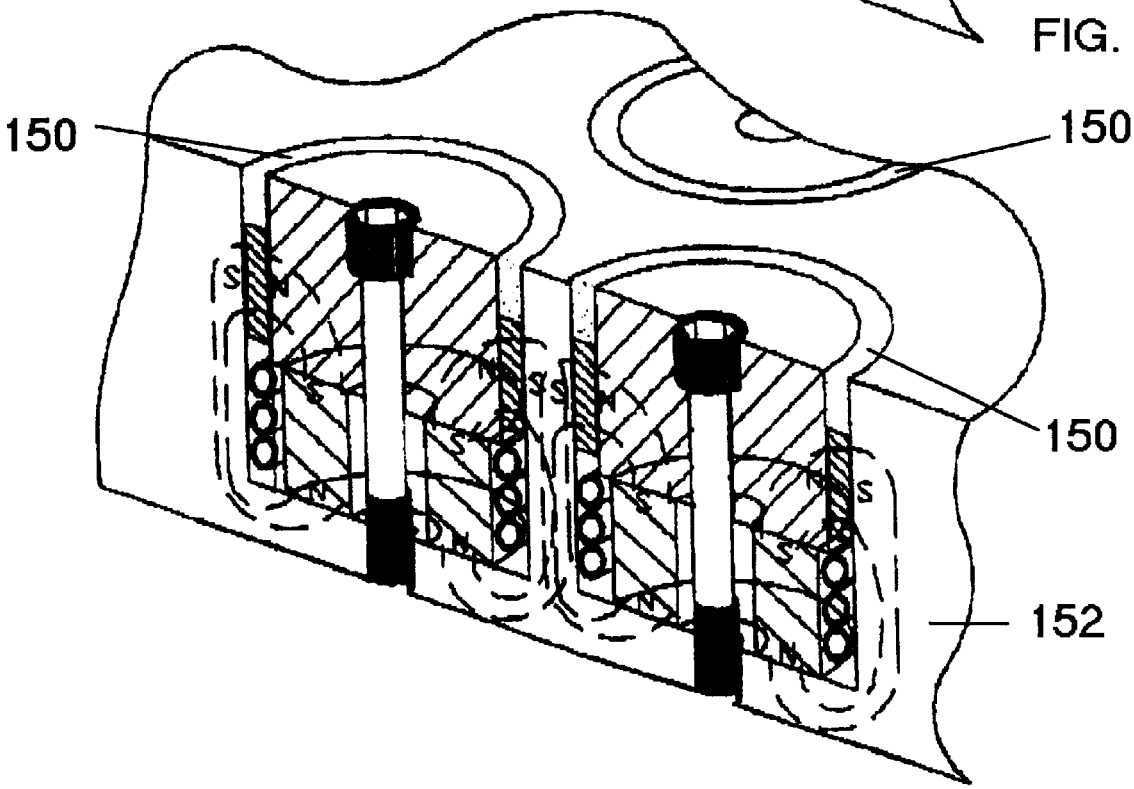
FIG. 9 is a partially sectioned perspective view of the magnet system of FIG. 1 in the inactive state.

The devices may be deployed randomly for clamping varying configurations of workpieces without magnetic interference from or with adjoining devices. As shown in FIGS. 8 and 9, magnet modules 150 in accordance with the above are disposed in suitable bores within a pole field 152, in close proximity and irregular array, generating representatively the flux pattern in the active state shown and FIG. 8 and in the inactive state in FIG. 9. Tests have indicated that such devices may be deployed in abutting relationship without interference or diminution in magnetic performance. Such tests further indicate that the present design presents a shallow magnetic flux height and evenly balanced about the perimeter thereof. In such dispositions, it may be advantageous to employ a standardized module.

Figure 7:
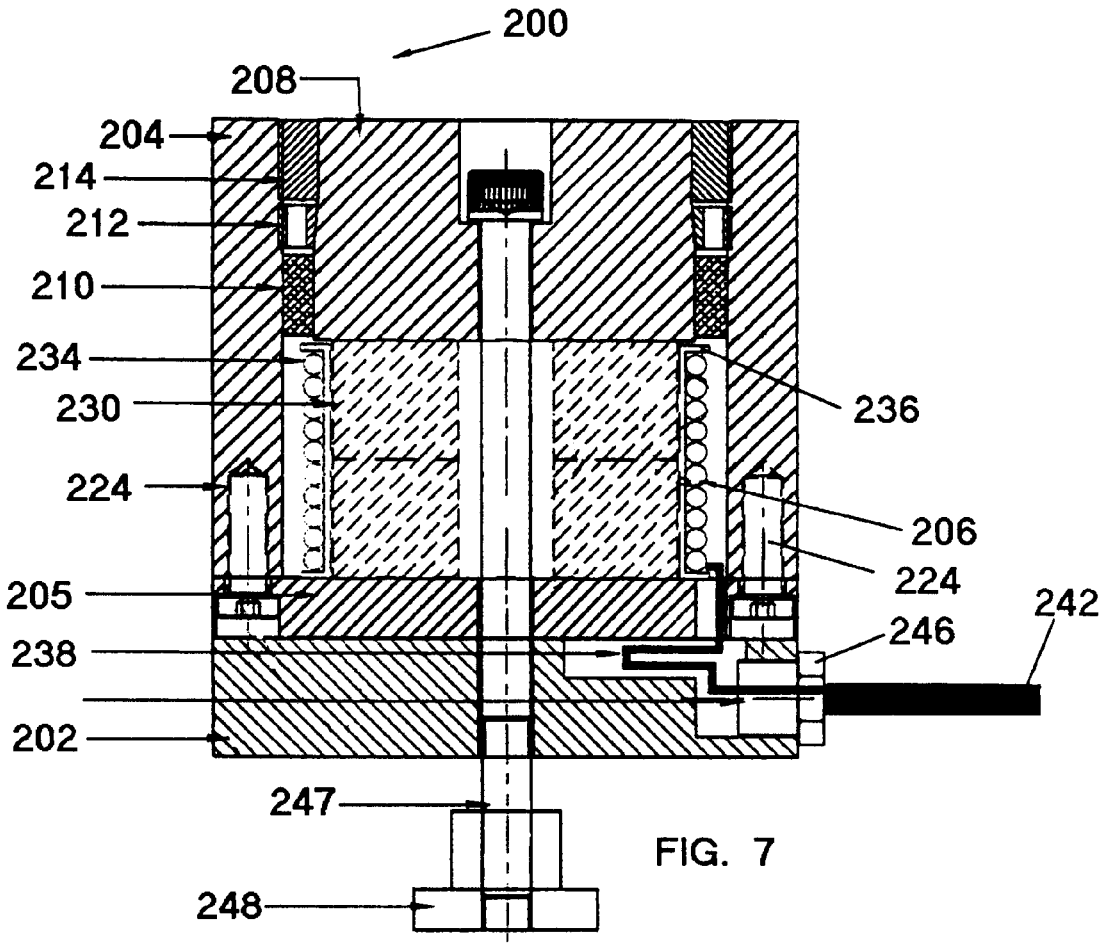
FIG. 7 is a cross sectional view of a further embodiment illustrating a magnet module and switching connector.

Referring to FIG. 7, a magnet module 200 for integration into a modular array is mounted on a base plate 202 that may be suitably mounted on a support platform, not shown, such as a bed of a manufacturing tool. Depending on the application, one [or] of more modules may be employed.

Each module 200 comprises a cylindrical outer induced pole 204, a base 205, and inner core assembly including a switchable electromagnet assembly 206 and an inner pole 208. An annular permanent magnet 210 is coupled between the outer pole 204 and the inner pole 208. The components are compressively retained by a clamping ring 212 and a retainer ring 214. A clamp screw 216 extends through the module along the central vertical axis 218 thereof and has a threaded shank 220 that is threadedly connected to a conventional tee nut 222 retained in the bed of the machine. In a conventional manner the clamp screw may be tightened to fixedly secure the module in place on the machine.

The outer pole 204 is fixedly connected to the base 205 by fastener 224. The switchable magnet assembly 206 includes an annular switchable permanent magnet 230 surrounded by a solenoid assembly including a coil 234 carried on a frame 236. The coil 234 includes leads 238 that extend through an opening in the base 205 into a transverse channel in the base plate 202 and outwardly of the module at a strain relief connector 240 via cable 242.

For fastening the inner core assembly, the center band of the inner pole is provided with a downwardly outwardly flaring frustoconical section. The inner surface of the outer pole is provided with a threaded section. The clamping ring has an inner conical surface mating with the inner pole and an outer threaded surface connected with the outer pole. The ring includes a plurality of axial holes for engagement with a suitable tool not shown for threading the clamping ring downwardly whereby at the conical surfaces the inner pole and the magnet are compressively retained against the base. The retainer rings is similarly threaded into the outer pole. The ring may be initially oversized and finished to size after assembly.

Figure 10:
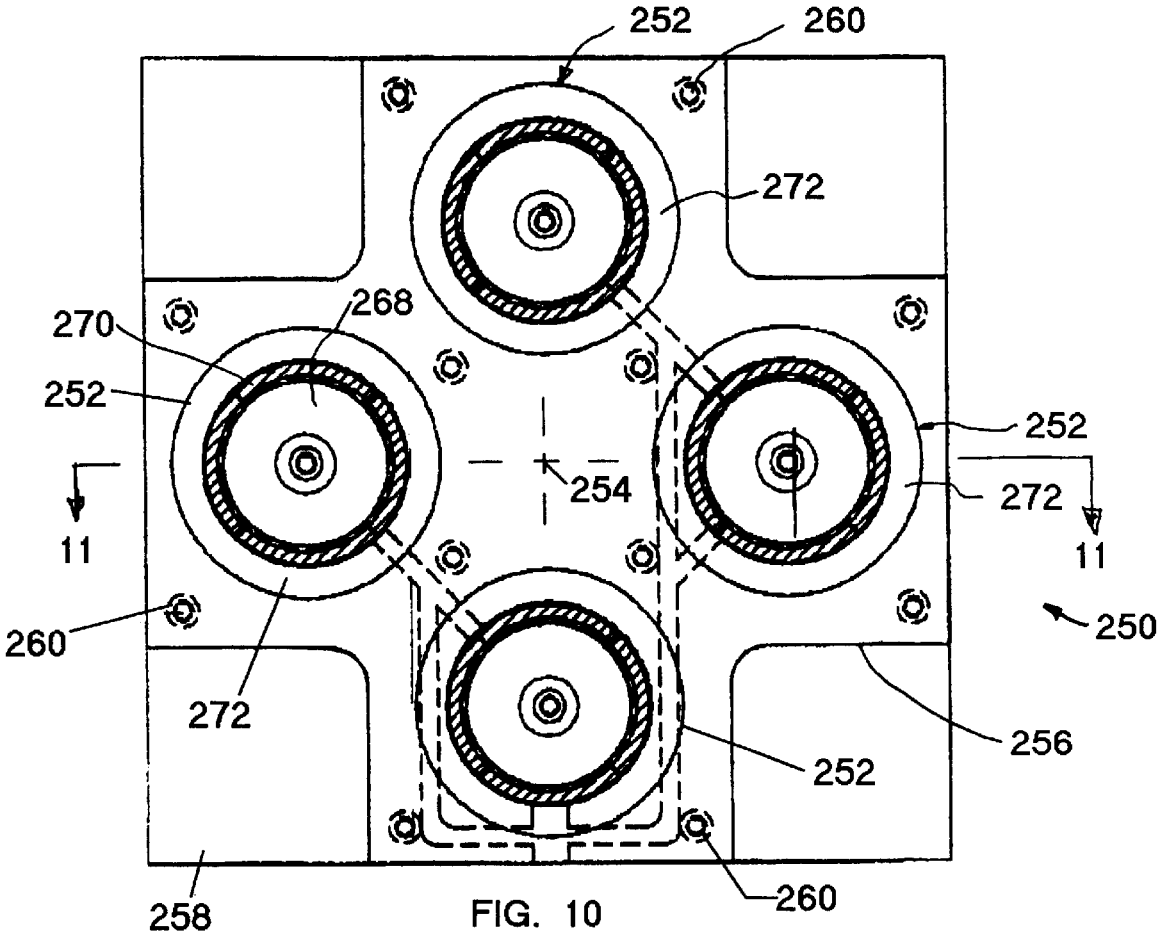
FIG. 10 is a top view of another embodiment illustrating a magnet assembly having a unitary outer pole field.
Figure 11:
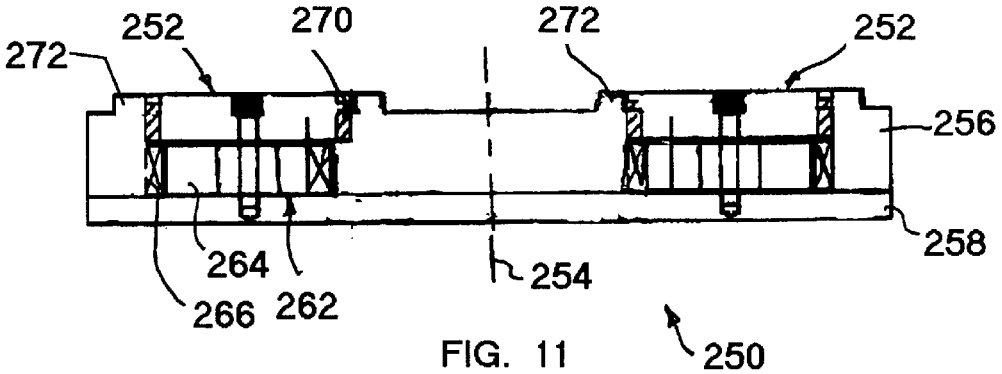
FIG. 11 is a cross sectional view taken along line 11—11 in FIG. 10.

As mentioned above, the magnet assemblies do not require discretely formed and/or defined outer poles, requiring only sufficient spacing on a random basis to establish a constructive pole area for effective flux distribution. Accordingly, multiple modules may be arrayed within an outer pole plate for providing magnetic clamping force in prescribed and desired locations. An illustrative example is shown in FIGS. 10 and 11 wherein a magnetic fixture 250 includes four integrated magnet modules 252. The modules 252 are evenly circumferentially spaced with regard to a central vertical axis 254. The magnetic fixture 250 comprises the four modules 252 carried in a four armed yoke 256 and mounted on a rectangular base plate 258. The yoke 256 is connected to the base plate 258 by a plurality of fasteners 260.

Each module 252 includes a switchable magnet assembly 262 including a core 264 and a solenoid 266, a center pole 268, a radial permanent magnet 270 and an outer pole 272 formed at the top surface of the yoke 256. The yoke 256 is provided with a network of downwardly opening cable grooves 274 in the bottom surface thereof. The grooves 274 interconnect the modules 252 and terminate with an entry channel 276. The network provides a cable duct for the routing of the cables to the various solenoids 266. By means of a connector cable, not shown, the solenoids are connected to a suitable control and power supply for selectively switching the polarity of the switchable magnets 262.

The yoke 256 is provided with through holes for receiving the interior module components, the cylindrical surface thereof and the upper surface of the base 258 forming the structural cavity for the components.

Figure 12:
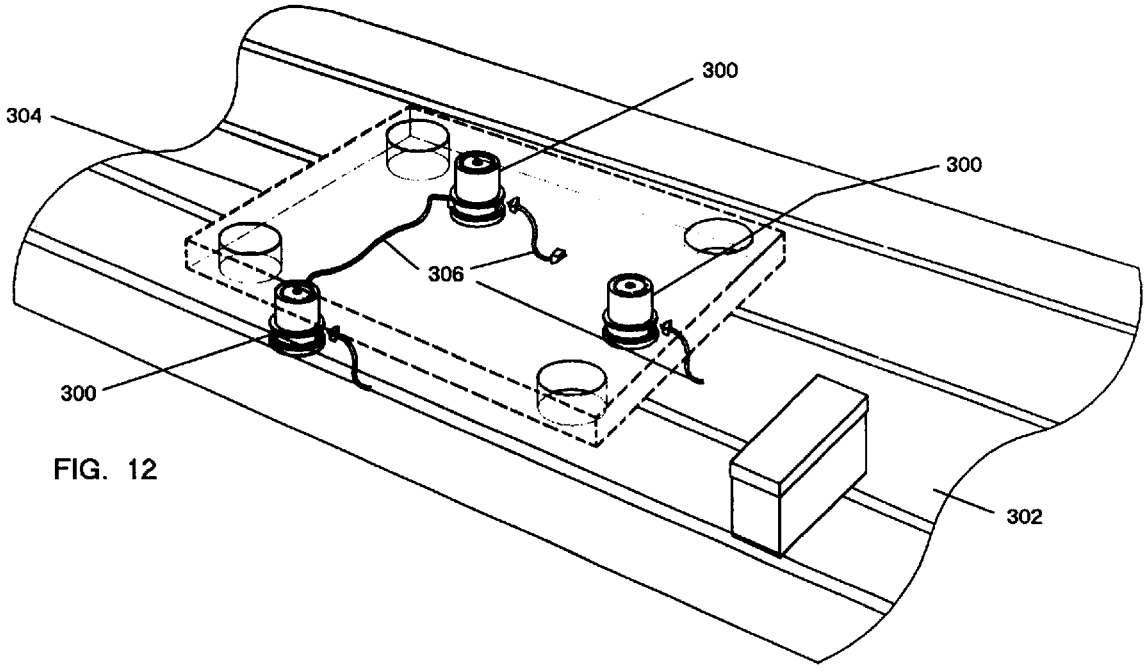
FIG. 12 is a perspective view of switchable magnet modules deployed in spaced array for coupling with a workpiece.

The magnet modules may also be deployed as independent units. As shown in FIG. 12, a plurality of modules 300 are arrayed on a machine bed 302 in spaced relationship for magnetic coupling with a workpiece 304. The modules 300 include connectors 306 for connection with and operation by a suitable control system.

With regard to the foregoing embodiments, to achieve maximum clamping force in a given area inasmuch as only the pole contact surfaces in combination with the workpiece contribute to actual clamping force the design must maximize pole area to the required paramagnetic area. This is affected by the application and the reluctance offered by the workpiece condition. The more reluctant the circuit the greater the chance for magnetic leakage between the poles, bearing in mind that leakage will reduce flux density at the pole/workpiece interface and cause a diminishment of clamping force. As the clamping force is proportional to the square of the flux density at the pole/workpiece interface, it is important to maximize flux density. The limitation of the flux density at the polar surface is determined by many factors but in general terms, the overall permeance of the circuit must be taken into account, including: the magnet materials and their respective Remanent Flux Density's (Br); the materials associated with the transfer of flux (baseplate, poles etc.); the adequacy of volumetric dimensions of the circuit; the method in which the circuit is connected (likely air-gaps between parts, for example). Using highly permeable ferromagnetic material and minimizing air-gaps improves overall magnetic efficiency. Further, the more reluctant the magnetic circuit the more MMF (magnet motive force) will be required to compensate, i.e. MMF=flux×reluctance. In a permanent magnet application MMF=H×L. As the Field (H) is already determined in the raw magnet after selection MMF may be increase by its length (L) which, for a "compact" design needs to be kept to a minimum. Maximum flux density at the pole interface, having taken into account the above points will be ultimately determined by the ability for the steel to absorb the flux—"saturation" (Bs) Good permeable steel saturates at 2.0 Tesla. The best magnetic materials in terms of Br can deliver 1.2–1.3 Tesla in an efficient circuit. Therefore, polar saturation cannot be achieved if the contact area of the magnet is similar or less than the contact area of the pole. According, a ratio of around 1.7:1 (in favor of magnet area to pole area) is desireable.

Alternatively, since magnetic saturation is only important at the workpiece interface, saturation can also be achieved with a pole making contact with the magnet of equal area but the pole then diminishes in area at the interface to the ratio shown above (pyramidic). The disadvantage of this design is that the paramagnetic gap between the poles increase. The respective magnetic lengths which contribute to the MMF are not only important to offset natural circuit reluctance, but in a "double" magnet system (Pot technology, for example) each magnet must have a magnetic length of correct proportion so as not to have a demagnetizing effect on the other. A final consideration for maximum clamp capability is the fact that for any pole to achieve its potential the circuit must have the opposite pole in play. An imbalance of polarity not only reduces performance capability but exaggerates stray flux. For example, the calculation of clamp force when 1 (whole) North pole is in contact with the workpiece and ½ South Pole is in contact would be based upon the flux density of the poles and the area of poles in balance, in this case, 2×½. The remaining ½ North pole contributes nothing except magnetic flux with no return path.

To achieve an adequate "OFF" state at polar surface, the elimination of residual flux at the polar surface in a permanent magnetic circuit requires that all materials are fully demagnetized. In cases where polar saturation is desired and the best way of achieving this is through a double magnet style, then this problem worsens. This is effected by providing a better, alternative route for magnetic flux to flow within the circuit internally than externally through the workpiece. This means that the two types of magnets must work in perfect balance. As the commercial variances for magnetic performance can be quite large, following assembly, additional work is required to offset any imbalance. This may be accomplished by increasing or reducing magnetic area. Since many assemblies involve multiple poles that are connected to each other, any adjustment of magnet volume, which affects a given pole is likely to affect not only adjacent poles but even others that are further divorced.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed:

1. A magnetic device, comprising: a cylindrical outer pole having a central axis and formed of a ferromagnetic material, said outer pole including a circular base and a cylindrical sleeve defining a cylindrical cavity opening outwardly from said base; a reversible magnetic unit located in said cavity including a cylindrical core having a magnetic axis aligned with said central axis and a normal magnetic polarity in an inactive state; a cylindrical inner pole formed of a ferromagnetic material operatively coupled to said core and inwardly radially spaced from said sleeve; an annular band between said sleeve and said inner pole, said band formed of a permanent magnetic material having a magnetic polarity transverse to said central axis and magnetically aligned with said normal magnetic polarity of the core whereby an internal magnetic circuit is established in the inactive state through said poles, said core and said permanent magnet to the exclusion of said workpiece, said reversible magnetic unit being operative to reverse the polarity of said core whereby an external circuit is established between said poles and said workpiece.

2. A switchable permanent electromagnet, comprising: external pole means having an inner cylindrical wall defining a cavity with a central axis and a base at the bottom of said cavity, said external pole means including a top surface transverse to said central axis and formed of a ferromagnetic material, said top surface circumscribing a constructive flux receiving annulus; reversible magnetic means located in said cavity including a cylindrical core having a magnetic axis aligned with said central axis for establishing a normal magnetic polarity in an inactive state; a cylindrical inner pole formed of a ferromagnetic material operatively coupled to said core and inwardly radially spaced from said inner cylindrical wall, said inner pole having a top surface coplanar with said top surface of said external pole means; sleeve means interposed between said inner cylindrical wall and said inner pole, said sleeve means formed of a permanent magnetic material and having a magnetic polarity transverse to said central axis and magnetically aligned with said normal magnetic polarity of the core whereby an internal magnetic circuit is established in the inactive state through said reversible magnetic means, said poles, said core and said permanent magnet to the exclusion of said workpiece, said reversible magnetic means being operative to reversing said normal magnetic polarity of said core whereby an external circuit is established with the workpiece.

3. A switchable permanent electromagnet system, comprising: plate means having an upper working surface; an array of cylindrical cavities formed in said plate means, each of said cavities being defined by a cylindrical side wall having a opening at said working surface with a central axis and a base wall below said upper working surface transverse to said central axis, said plate means being formed of a ferromagnetic material, said top surface circumscribing a constructive flux receiving annulus surrounding each cavity; a cylindrical reversible magnetic core located in said cavities and having an outer cylindrical surface radially inwardly spaced from said cylindrical side wall of an associated cavity defining therebetween an annular recess, said core means having a magnetic axis aligned with said central axis for establishing a normal magnetic polarity in an inactive state; solenoid means in said recess operatively surrounding said core means; a cylindrical inner pole formed of a ferromagnetic material operatively coupled to said core and inwardly radially spaced from said inner cylindrical wall, said inner pole having a top surface coextensive with said working surface of said plate means; sleeve means interposed between said cylindrical side wall and said inner pole, said sleeve means formed of a permanent magnetic material and having a magnetic polarity transverse to said central axis and magnetically aligned with said normal magnetic polarity of the core whereby an internal magnetic circuit is established in the inactive state through said reversible magnetic means, said poles, said core and said permanent magnet to the exclusion of said workpiece; channel means in said plate means communicating with said cavities; connector means disposed in said channel means and connected at one end to said solenoid means; control means connected at said other end of said connector means and operatively connected therethrough with said solenoid means for reversing said normal magnetic polarity of said core whereby an external circuit is established with the workpiece to said constructive annulus, the arrangement being such that said cavities are relatively spaced to define constructive pole areas therearound sufficient to prevent magnetic interference between said magnetic circuits.

4. A switchable permanent electromagnet system, comprising: plate means formed of a ferromagnetic material having a planar working surface; an irregularly spaced plurality of cylindrical cavities formed in said plate means defined by cylindrical side walls having openings at said working surface and a central axis orthogonal to said upper working surface and a base located below said working surface; a cylindrical reversible magnetic core located in said each of said cavities engaging said base, said reversible magnetic core having an outer cylindrical surface radially inwardly spaced from said cylindrical side wall of an associated cavity, said core means having a magnetic axis aligned with said central axis for establishing a normal magnetic polarity in an inactive state; solenoid means in said cavity between said core and said side wall of said cavity; a cylindrical inner pole formed of a ferromagnetic material engaging and operatively coupled to said core and inwardly radially spaced from said inner cylindrical side wall, said inner pole having a top surface coextensive with said working surface of said plate means; an annular permanent magnetic material mechanically and magnetically coupled between said side wall and said inner pole and having a magnetic polarity transverse to said central axis and magnetically aligned with said normal magnetic polarity of the core whereby an internal magnetic circuit is established in the inactive state through said reversible magnetic means, said poles, said core and said permanent magnet to the exclusion of said workpiece; and means for reversibly momentarily energizing said solenoid means for reversing the magnet polarity of said pole.

* * * * *